US005295901A

United States Patent [19]

Sexton

[11] Patent Number: 5,295,901

[45] Date of Patent: Mar. 22, 1994

[54] TOP SEALING CHIMNEY CAP

[75] Inventor: Walter Sexton, Foster, Ky.

[73] Assignee: Lyemance International, Inc., Jeffersonville, Ind.

[21] Appl. No.: 924,730

[22] Filed: Aug. 3, 1992

[51] Int. Cl.[5] ..... F23L 17/10

[52] U.S. Cl. ..... 454/4; 454/29

[58] Field of Search ..... 126/286; 454/4, 29, 454/224, 323, 334, 348, 362, 5, 6, 7

[56] References Cited

U.S. PATENT DOCUMENTS

| | | | |
|---|---|---|---|
| 2,410,950 | 11/1946 | Knutson | 454/362 |
| 3,251,336 | 5/1966 | O'Brien | 454/5 X |
| 3,386,368 | 6/1968 | Fielding | 454/348 |
| 4,020,754 | 5/1977 | Dalsin et al. | 454/4 |
| 4,368,663 | 1/1983 | Tabacco | 454/7 |
| 4,528,897 | 7/1985 | Homolik | 454/7 |
| 4,554,863 | 11/1985 | Dalsin | 454/4 |
| 5,080,006 | 1/1992 | Vonsick | 126/286 X |
| 5,125,869 | 6/1992 | Vonsick | 454/4 |

*Primary Examiner*—Harold Joyce
*Attorney, Agent, or Firm*—Scott R. Cox

[57] ABSTRACT

A chimney damper and chimney cap system comprised of a support base securable to the top of a chimney flue, a bracket and spring assembly secured to the support base, a chimney cap secured to the bracket and spring assembly wherein the bracket and spring assembly bias the chimney cap to an open position, a damper cable secured to the bottom portion of the chimney cap and a support arm secured to the support base for supporting the damper cable within the chimney flue.

4 Claims, 4 Drawing Sheets

TOP SEALING CHIMNEY CAP

BACKGROUND OF INVENTION

1. Field of Invention

This invention relates to chimney dampers and chimney caps. More particularly, this invention relates to an improved chimney cap which uses a spring mechanism to keep the chimney damper open.

2. Prior Art

In homes and other buildings having a fireplace, the fireplace opening is connected to a chimney flue which is open to the outside of the building. When in use, the combustion products from the fireplace pass up through the flue and exit the chimney in a conventional fashion.

When the fireplace is not in use, however, the fireplace opening and chimney flue form a passage through which heat can escape from the interior of the building. Although most fireplaces contain conventional fireplace dampers at the bottom of the flue or immediately above the fireplace opening, these fireplace dampers do not usually provide an adequate seal for the chimney flue. This inadequate seal permits a great deal of heat loss through the chimney flue.

A number of chimney dampers have been produced which are mounted on the top of the chimney to provide a better seal and thus reduce the amount of heat lost through the chimney flue. Various types of chimney dampers are available. For example, one well known type of chimney damper is a cap-type flue damper as shown in U.S. Pat. Nos. 4,554,863, 4,181,119 and 4,020,754.

Another common type of chimney damper has a lid attached to the side of the chimney by hinges as shown in U.S. Pat. Nos. 4,691,624, 4,528,897, 4,483,315, 4,368,663 and 2,856,839.

Another common type of chimney damper contains a frame secured to the top of the chimney and a flap which is pivotally attached to the frame to provide an improved method of both closing the flue and also preventing air and water from flowing over the damper flap into the chimney. See, for example, U.S. Pat. No. 2,704,502 and the particularly preferred devices shown in U.S Pat. Nos. 3,945,307 and 4,165,679.

Many common chimney dampers also use springs or other such apparatus to orient the chimney damper to an open position. See, for example, U.S. Pat. Nos. 4,165,679, 3,945,307, 5,080,006 and 4,368,663.

Another common element attached to the top of chimneys regardless of whether a chimney damper system is used is a chimney cap which may or may not use screens. Smoke from a fire commonly rises up through the chimney, carrying with it ash and sometimes larger particles. Chimney caps and/or screens which are attached at the top of the chimney limit the amount of hot particles which pass into the environment. Further, these screens prevent small animals, such as birds, from entering the chimney flue.

While the use of a chimney damper which is oriented to an open position is a required element in any modern dampers, the combination of an open-oriented chimney damper with a chimney cap and screen would provide both the safety and security of an open-oriented chimney damper with the protection from hot ash and security created by the chimney cap and screen.

Accordingly, it is an object of this invention to provide a combination chimney cap and chimney damper containing means to force the chimney damper to an open position.

It is a still further object of the invention to provide a chimney damper containing a frame to support a device for securing the damper in its closed position.

It is a still further object of the invention to provide a bracketed spring system designed to force the damper to an open position within the chimney cap and screen system.

These and other objects are obtained by the improved chimney damper of the instant invention.

SUMMARY OF INVENTION

The instant invention is an improved chimney damper and cap system comprised of a support base securable to the top of a chimney flue, a support frame secured to the support base extending above the support base, a chimney cap secured to the top of the support frame, a bracket and spring assembly secured to the bottom portion of the chimney cap, a chimney damper cover plate secured to the bracket and spring assembly wherein the bracket and spring assembly biases the cover plate to an open position toward the chimney cap, a damper cable secured to the bottom portion of the chimney damper cover plate and a support arm secured to the support base for supporting the damper cable within the chimney flue. The operation of the bracket and spring assembly biases the chimney damper cover plate into an open position toward the chimney cap. In addition, the screen system installed in the frame limits the amount of hot ash and other particulate matter which can escape from the chimney and prevents small animals from entering the chimney flue.

In an alternate preferred embodiment, the bracket and spring assembly is directly connected between the support base and the chimney cap and biases the chimney cap into an open position. This alternative preferred embodiment is comprised of a support base securable to the top of a chimney flue, a chimney cap, a bracket and spring assembly secured between the bottom surface of the chimney cap and the support frame, a damper cable secured to the bottom portion of the chimney cap and a support arm secured to the support base for supporting the damper cable within the chimney wherein the bracket and spring assembly biases the chimney cap to an open position. In addition, as an additional element of the alternative preferred embodiment, there is secured to the end of the damper cable adjacent to the bottom surface of the damper cap a tubular piece which is attached to a spring secured to the bottom of the chimney cap such that when the spring is stretched by pulling the damper cable and then released, the tubular piece moves abruptly upward to strike the underside of the chimney cap. This striking of the chimney cap is designed to free a stuck chimney cap.

BRIEF DESCRIPTION OF THE DRAWINGS

This invention will now be described with reference to the accompanying drawings in which.

DETAILED DESCRIPTION OF THE PREFERRED EMBODIMENT

Figure 1:
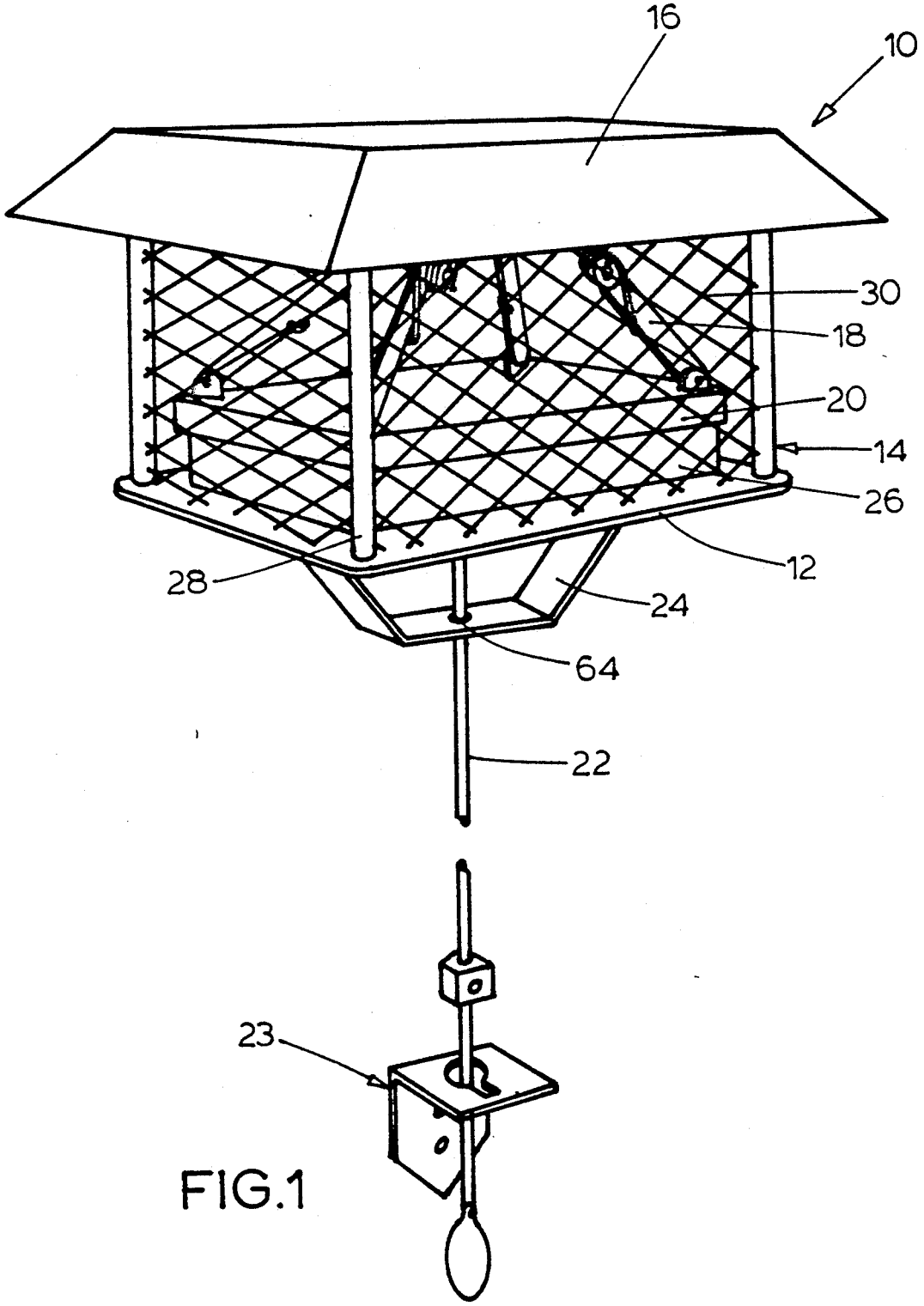
FIG. 1 is a perspective view of the improved chimney damper cap system in accordance with the present invention with the chimney damper in its closed position.

Although the invention is adaptable to a wide variety of uses, it is shown in the drawings for purpose of illustration as an improved chimney damper and chimney cap system (10) comprised of a support base (12), a support frame (14), a chimney cap (16), a bracket and spring assembly (18), a chimney damper cover plate (20), a damper cable (22) and a support arm (24), See FIG. 1.

The support base (12) is designed to rest on the top of the outlet of the flue of a chimney. The support base can be of any particular design limited only by the shape of the flue outlet. In one preferred embodiment, the support base (12) is rectangular in shape and includes an upstanding, inner flange (26). In an optional embodiment a sleeve (not shown) may be secured to the bottom of the support base to fit within the chimney flue to provide additional support for the device. The support base (12) is secured to the flue by conventional means well known in the industry, such as by an appropriate adhesive.

Figure 2:
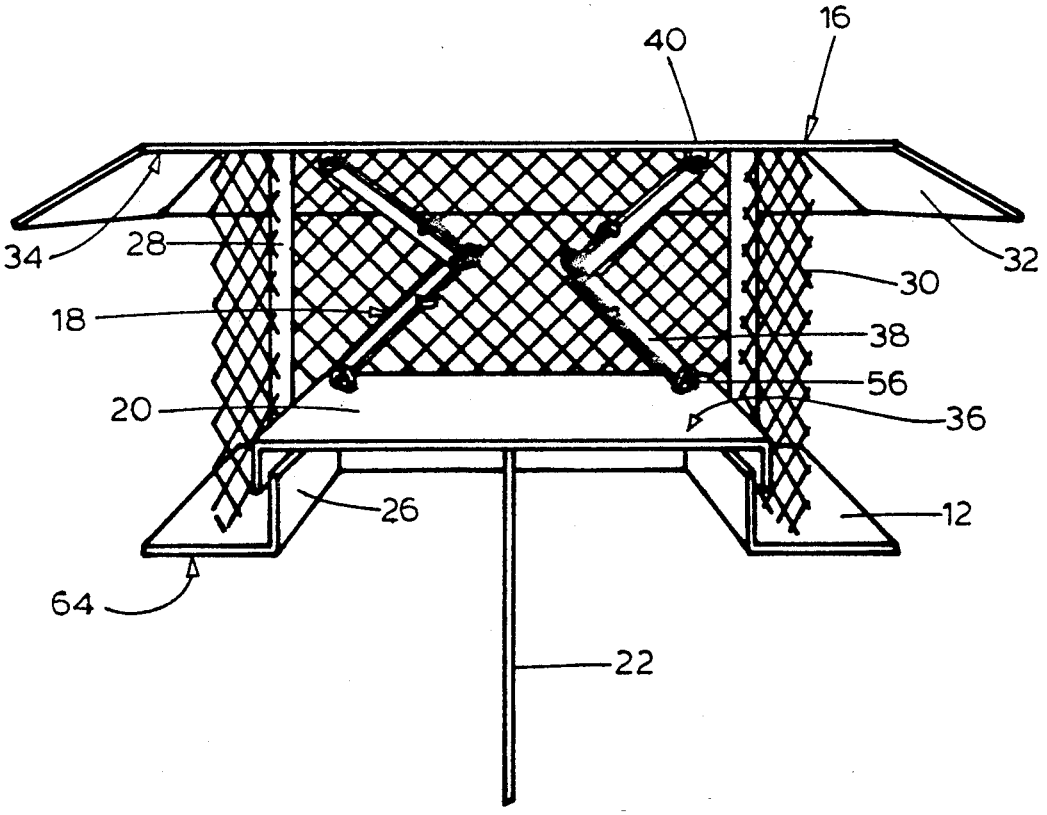
FIG. 2 is a partially cut away illustration of the device shown in FIG. 1 in its closed position.

Secured to the support base (12) above the level of the chimney flue is the support frame (14). This support frame (14) can be of many different types of structure and shape but, preferably, it will have the same cross sectional shape as the support base (12). In a preferred embodiment, each corner of the support base contains a support bar (28) which extends upward a sufficient distance both to support the chimney cap and to provide sufficient space for smoke to leave the chimney flue. This height can be any conventional distance between the flue opening and the chimney cap and, preferably, it is from about 4" to about 24". In one preferred embodiment each of these support bars (28) is secured at their bottom portion to the corners of the support base (12). See FIG. 2.

Though not required, in a preferred embodiment, a set of screens (30) is installed in the frame to surround the chimney flue opening. See FIGS. 1 and 2. This set of screens will screen out ash and other large particulate matter which escapes the chimney flue and also prevent small animals from entering the chimney flue. The size of the openings in the screen is conventional and should not be too small to prevent the free flow of the smoke that comes forth from the chimney flue. In one embodiment where the support base is of rectangular construction, a rectangular sheet of screen is secured between each corner support bar (28) of the support frame with the bottom portion of the screen resting against the support base (12) and its top portion resting against the chimney cap (16).

The chimney cap (16) is secured to the support frame to support the chimney cap. In a preferred embodiment with a rectangular support base, the chimney cap is secured to the top portion of each support bar (28) at each corner of the frame (14) by a conventional securing means such as bolts, screws or welding.

The chimney cap (16) is generally planer in configuration and fabricated from, preferably, a metal sheet. Each side (32) of the chimney cap is deflected downward to deflect any particulate matter which strikes the chimney cap after leaving the chimney flue. If a set of screens (30) is used, the top portion of each screen unit will meet the bottom portion of the chimney cap (16).

Figure 3:
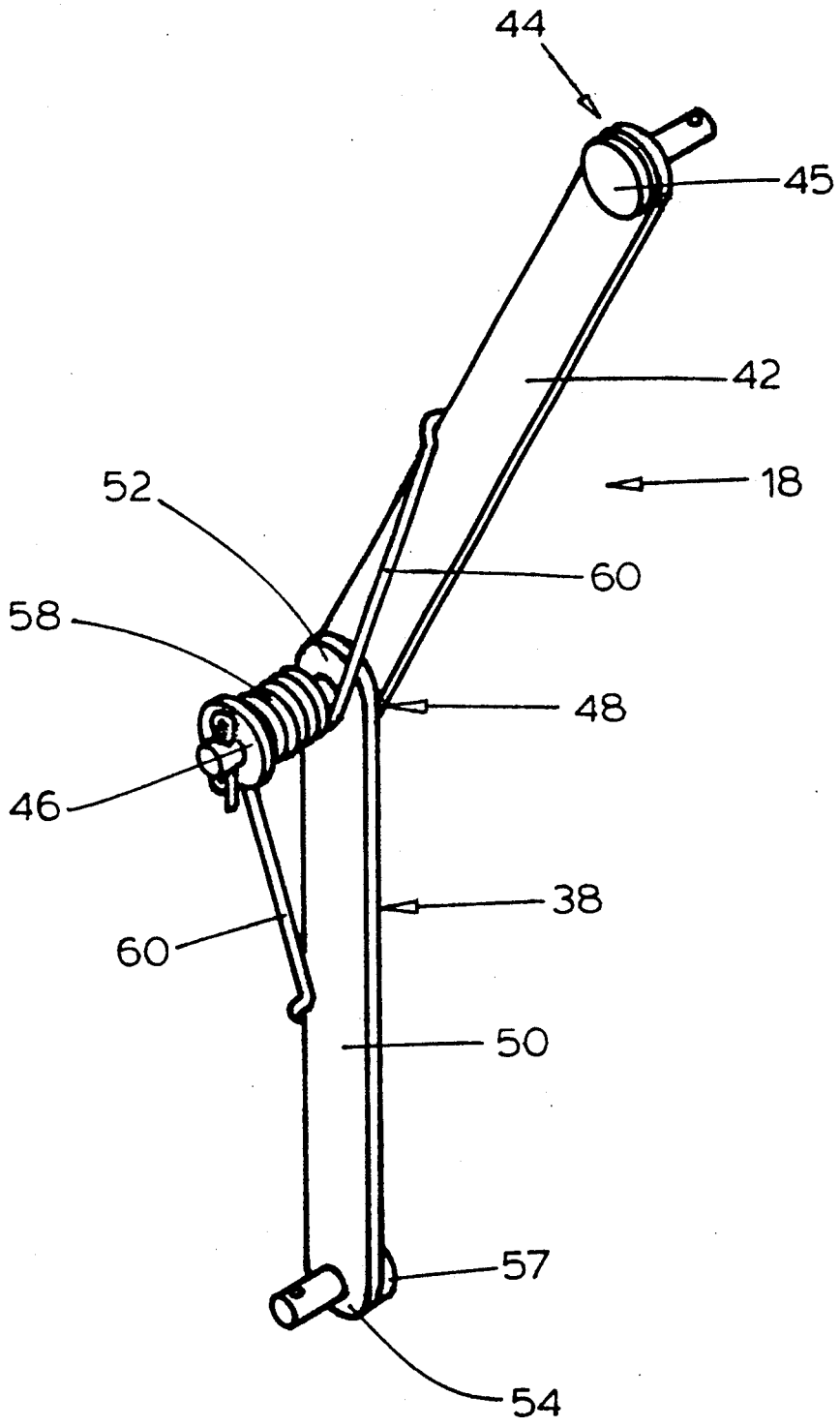
FIG. 3 is a side view of the bracket and spring assembly of the chimney cap system.

Secured to the bottom portion of the chimney cap within the area outlined by the support frame (14) and the set of screens (30) is the bracket and spring assembly (18). See FIG. 3. The bracket and spring assembly is attached to the bottom surface (34) of the chimney cap and the top surface (36) of the chimney damper cover plate (20). The assembly (18) biases the chimney damper cover plate away from the support base (12) and toward the chimney cap (16), thus, biases the cover plate (20) to an open position. This assures that the chimney flue will remain in an open position unless it is secured closed by pulling the damper cable (22).

Various systems can be designed using the bracket and spring assembly (18) to bias the chimney damper cover plate (20) to an open position, but the preferred method utilizes a plurality of bracket and spring units (38). Preferably, when the chimney damper cover plate (20) is generally rectangular in shape, one of these bracket and spring units (38) is secured at each corner of the chimney damper cover plate (20) and also secured at each of the corners of the chimney cap (16).

The preferred embodiment of each of these bracket and spring units (38) (FIGS. 2 and 3) is comprised of a chimney cap bracket (40) secured to the bottom surface (36) of the chimney cap (16), a first bar (42) whose first end (44) is rotatably secured to the chimney cap bracket (40) by a chimney cap bracket pin (45), a pivot pin (46) rotatably secured to the second end (48) of the first bar (42), a second bar (50) whose first end (52) is also rotatably secured to the pivot pin (46) and whose second end (54) is rotatably secured to a chimney cap cover plate bracket (56) on the top surface (36) of the chimney cap cover plate (20) by a chimney cap cover plate bracket pin. A coil spring (58) is secured around the outside of the pivot pin (46) with wing portions (60) which press against the edges of the first (42) and second bar (50) to bias the second bar (50) toward the first bar (42) which then forces the bars together to force the damper cover plate (20) toward the chimney cap (16) and thus forces the chimney damper to an open position.

The size of the bars used in this system depends on the distance to be traveled by the chimney damper cover plate (20). In a conventional system when the chimney damper cover plate will travel approximately 8", each of these bars (42, 50) will be, preferably, about 3" to 5" in length. The coil spring (58) with wing portions (60) should be of sufficient strength to forcefully bias the two bars together. In a preferred embodiment the spring is an 0.062 stainless steel spring with a rate of about 0.05 inch pounds per degree.

As previously stated, a plurality of the bar and spring units (38) are secured to the bottom portion of the chimney cap and the top portion of the damper cover plate and in a preferable embodiment, four units are used, one secured at each corner.

The chimney damper cover plate (20) is a generally planer in configuration, preferably, with a downward extending lip (50) around its outside with its shape preferably to conform to the shape of the chimney flue. On the inside surface of that lip is preferably placed a seal (not shown), such as a rubber gasket, to assist in the complete sealing of the chimney flue.

Secured to the bottom surface of the chimney damper cover plate is the damper cable (22) which extends downward in the chimney to the fireplace opening. The cable is conventional as is shown, for example, in U.S.

Pat. Nos. 3,945,307 and 4,165,679. The chimney damper cover plate (20) can be closed by pulling the cable downward to force the cover plate to a closed position, either against the flue itself or against the upturned lip of the support base. The chimney damper cover plate (20) remains closed when the cable is secured in place by a latch element (23) which is well known in the industry. The bracket and spring assembly (18) which is secured to the bottom surface (36) of the chimney cap and the top surface (30) of the chimney damper cover plate biases the chimney damper cover plate in an open position unless the cable has been secured in the latch element.

Preferably, an additional element added to the support bar is the support arm (24) preferably secured to the bottom surface (62) of the support base. The support arm has an opening (64) through which the damper cable passes. While the support arm (24) is shown as an extended arm having an opening, the support arm may also take the form of a tube or other means such as a bottom eyelet which has a fixed bottom opening through which a cable may pass. The support arm serves the function of assisting in the proper closing of the chimney damper cover plate. Even if the cable, after passing through the support arm, is directed to one side of the flue by the placement of the opening in the support arm directly below the bracket which secures the damper cable to the chimney damper cover plate, the chimney damper cover plate can be closed securely around all edges.

In operation, the support base (12) is placed on the top of a chimney and secured in place by a conventional securing means. In an alternative embodiment, a sleeve (not shown) may be secured to the bottom surface of the support base which will fit within the chimney. In normal operation, the chimney damper cover plate (20) is biased in an open position with this open position achieved by the operation of the bracket and spring assembly (18). To close the chimney damper cover plate (20), the damper cable (22) is pulled and fastened to the latch element (not shown) located near the fireplace. Upon release of damper cable from the latch element, the coil springs (58) of the bracket and spring assembly (18) bias the second bar (50) of each bracket and spring unit (38) toward the first bar (42) thus pulling the chimney damper cover plate (26) away from the surface of the support base (12) and the chimney flue. In the event that the damper cable (22) breaks, the chimney damper cover plate (20) will always "fail safe" to an open position because of the action of the coil springs (58) with the bars (42, 50) of the bracket and spring assembly (18).

Figure 4:
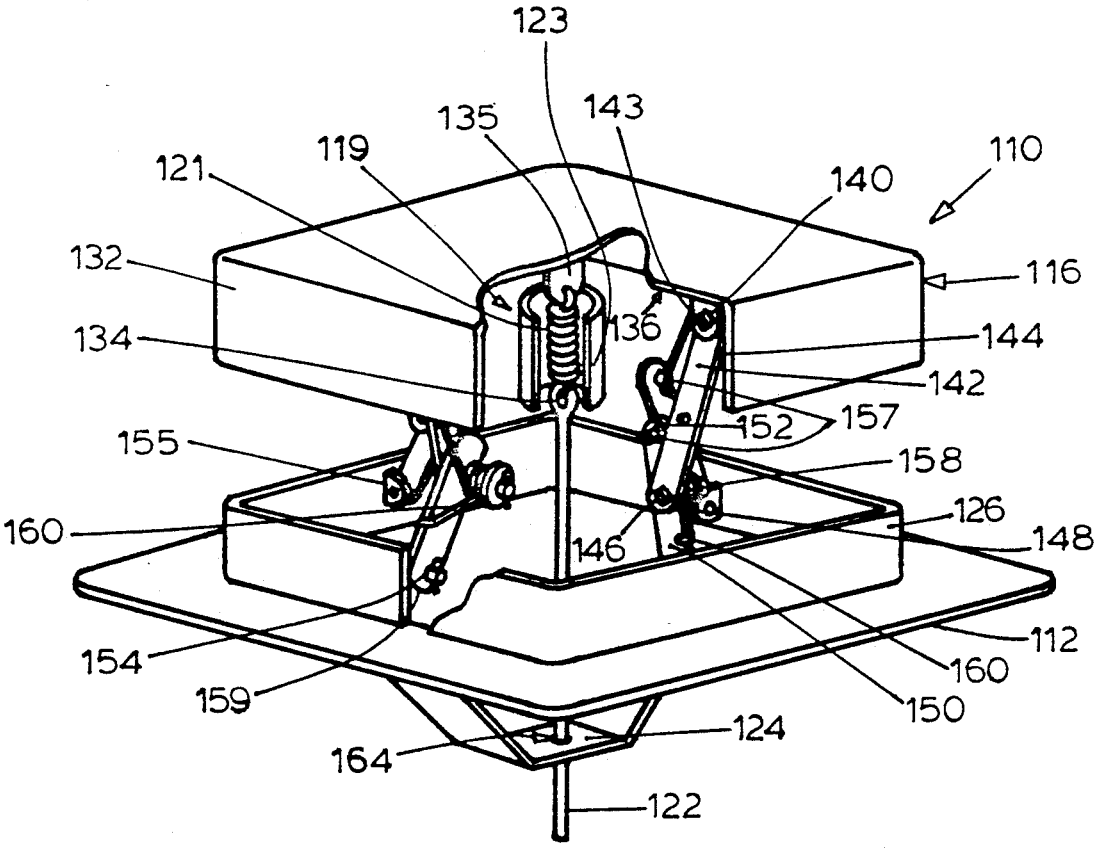
FIG. 4 shows a perspective view of the alternative improved chimney damper cap system in accordance with the present invention with the chimney cap in its open position.

In an alternative embodiment, the alternative improved chimney cap system (110) is comprised of a support base (112), a chimney cap (116), a bracket and spring assembly (118), a damper cable (122) and a support arm (124). Additional elements may also be added to this alternative embodiment including a tubular device (119) which attaches at the upper end of the damper cable (122) to be used for striking the bottom surface (136) of the chimney cap (116). See FIG. 4.

The support base (112) is similar in design to the previously discussed support base (12) and is designed to rest on the top of the outlet of the flue of the chimney. This support base (112) can be of any particular design, limited only by the shape of the flue outlet. In one preferred embodiment, the support base (112) is rectangular in shape and includes an upstanding, inner flange (126). An optional sleeve may be secured to the bottom of the support base to fit within the chimney flue to provide additional support for the device. The support base (112) is secured to the flue by conventional means well known in the industry such as by an appropriate adhesive.

Secured to the support base (112) above the level of the chimney flue by means of the bracket and support assembly (118) is the chimney cap (116). The chimney cap is generally planer in configuration and fabricated, preferably, from a metal sheet. Each side (132) of the chimney cap is deflected downward to deflect any particulate matter which strikes the chimney cap after leaving the chimney flue.

Secured between the bottom surface (136) of the chimney cap (116) and the inner edges of the inner flange (126) of the support base (112) is the bracket and spring assembly (118). See FIG. 4. The bracket and spring assembly (118) biases the chimney cap (116) away from the support base (112) to an open position. This assures that the chimney flue will remain in an open position unless it is secured closed by pulling the damper cable (122).

Various systems can be designed using the bracket and spring assembly (118) to bias the chimney cap to an open position, but the preferred method uses a plurality of bracket and spring units (138). preferably, when the chimney cap (116) is rectangular in shape, one of the bracket and spring units (138) is secured to each side of the support base (112) and correspondingly secured to the bottom surface (136) of the chimney cap (116).

The preferred embodiment of each of these bracket and spring units (138) (See FIG. 4) is comprised of a chimney cap bracket (140) secured to the bottom surface (136) of the chimney cap (116), a first bar (142) whose first end (144) is rotatably secured to the chimney cap bracket (142) by a chimney cap bracket pin (143), a pivot pin (146) rotatably secured to the second end (148) of the first bar (142), a second bar (150) whose first end (152) is also rotatably secured to the pivot pin (146) and whose second end (154) is rotatably secured to a support base bracket (155) by a support base bracket pin (159) which is secured on the inside surface of the upstanding inner flange (126) of the support base (112). A coil spring (158) is secured around the outside of the pivot pin (146) with wing portions (160) which press against the edges of the first (142) and second bar (150) to bias the second bar away from the first bar (142) forcing the bars apart which in turn forces the chimney cap (116) away from the support base (112) and thus forces the chimney cap to an open position. The rotation of the second bar (150) away from the first bar (142) is restricted by a rotation pin (157) secured to the end of the second bar beyond the pivot pin (146) on the same side of the second bar (150) as is the first end (144) of the first bar. As the second bar (150) rotates away from the first bar (142) the second end (148) of the first bar is prevented from further movement by the rotation pin (157). See FIG. 4.

The size of the bars used in this system depends on the distance to be traveled by the chimney cap (116). In a conventional system when the chimney cap will travel approximately 8 inches, each of these bars (142 and 150) will be preferably about 3 to about 6 inches in length. The coil spring (158) with wing portions (160) should be of sufficient strength to forceably bias the two bars apart. In a preferred embodiment the spring is an 0.062 stainless steel spring with a rate of about 0.05 inch pounds per degree.

As with the first embodiment, a damper cable (122) extends downward into the chimney to the fireplace opening. The cable is conventional as is shown, for example, in U.S. Pat. Nos. 3,945,307 and 4,165,679. The chimney cap can be closed by pulling the cable downward to force the chimney cap to a closed position against the upturned lip of the support base. On the bottom surfaces of the chimney cap is preferably placed a seal (not shown), such as a rubber gasket, to assist in the complete sealing of the chimney flue.

Preferably a support arm (124) is also secured to the bottom surface of the support base (112) in this alternative embodiment. The support arm has an opening (164) through which the damper cable passes. While the support arm (124) is shown as an extended arm having an opening (164), the support arm may also take the form of a tube or other means such as bottom eyelet which has a fixed bottom opening through which a cable may pass. The support arm serves the function of assisting in the proper closing of the chimney cap. Even if the cable, after passing through the support arm (124) is directed to one side of the flue by the placement of the opening in the support arm directly below the bracket which secures the damper cable to the damper cap, the chimney damper cap can be closed securely around all edges.

An additional element of this alternative preferred embodiment is a tubular devise (119) secured to the top portion of the damper cable (134). Secured to the end of the damper cable (133) is a damper cable spring (121) which is secured to the bottom surface of the chimney cap through a damper cable spring bracket (135). The tubular device is placed over the damper cable spring (121) and is held in place on the damper cable spring (121) by any conventional means such as a tubular pin (123) which passes through a portion of the damper cable spring (121). When the damper cable (122) is pulled downward, the damper cable spring is expanded which pulls the tubular pin (123) downward and permits the tubular device (119) to pull away from the bottom surface (136) of the chimney cap (116). By releasing the damper cable (122) the tubular device (119) will abruptly move upward to strike the bottom surface (136) of the damper cap, thus assisting in opening the damper cap.

In operation of this alternative embodiment, the support base (112) is placed on top of a chimney and secured in place by a conventional securing means. In normal operation the chimney cap (116) is biased away from the support base in an open position by operation of the bracket and spring assembly (118). To close the chimney cap, the damper cable (122) is pulled and fastened to a latch element (not shown) located near the fireplace. Upon release of the damper cable from the latch element, the coil springs (158) of the bracket and spring assembly (118) bias the second bar (150) of each bracket and spring unit (138) away from the first bar (142) thus forcing the chimney cap (116) away from the surface of the support base (112) and the chimney flue. In the event that the damper cable (122) breaks, the chimney cap (116) will always "fail safe" to an open position because of the action of the coil springs (158) with the bars (142, 150) of the bracket and spring assembly (118). If additional force is needed to open the flue, the damper cable (122) is pulled further downward thus pulling the tubular device (119) away from the bottom surface (136) of the chimney cap (116) and then the damper cable is released forcing the tubular device (119) upwards until it strikes the bottom surface (136) of the chimney cap, freeing it from being frozen against the top surface of the support base.

What is claimed is:

1. An improved chimney damper and chimney cap system for use with a chimney flue comprised of
   (a) a multi-sided support base securable to the top of the chimney flue;
   (b) a plurality of bracket and spring means, each said bracket and spring means having first and second ends, the first end of which is secured to opposite sides of the support base; wherein the plurality of bracket and spring means is comprised of a plurality of bracket and spring assemblies wherein each bracket and spring assembly is comprised of a first and second bar, wherein said first end of said first bar is secured to the chimney cap, the second end of the first bar and the first end of the second bar are rotatably secured to a pivot pin means, and the second end of the second bar is secured to the support base and wherein there is secured to the pivot pin means and the first and second bars a coil spring means which biases the bars apart;
   (c) a chimney cap secured to the second end of the plurality of bracket and spring means; and
   (d) a damper cable secured to the chimney cap.

2. The improved chimney damper and chimney cable system of claim 1 wherein there is secured to the first end of the second bar a rotation pin means which limits the rotation of the first bar in relation to the second bar.

3. The improved chimney damper and chimney cable system of claim 1 wherein there is also secured to the chimney cap a means for striking the bottom surface of the chimney cap.

4. The improved chimney damper and chimney cable system of claim 3 wherein the means for striking the bottom surface of the chimney cap is comprised of a damper cable spring secured between the damper cap and the damper cable, a tubular device means surrounding the damper cable spring and a tubular device pin means which secures the tubular device at a fixed location on the damper cable.

* * * * *